US007585262B1

(12) United States Patent
Vayntraub

(10) Patent No.: US 7,585,262 B1
(45) Date of Patent: Sep. 8, 2009

(54) CONVEX PUSH-UP HANDLES

(76) Inventor: Vladimir Vayntraub, P.O. Box 12953, Marina del Rey, CA (US) 90295

( * ) Notice: Subject to any disclaimer, the term of this patent is extended or adjusted under 35 U.S.C. 154(b) by 0 days.

(21) Appl. No.: 12/259,289

(22) Filed: Oct. 27, 2008

(51) Int. Cl.
*A63B 71/00* (2006.01)

(52) U.S. Cl. ..... 482/141; 482/62

(58) Field of Classification Search ..... 482/44, 482/49, 141, 62, 55; D21/662, 665
See application file for complete search history.

(56) References Cited

U.S. PATENT DOCUMENTS

| | | | | |
|---|---|---|---|---|
| 3,115,338 | A | 12/1963 | Acs et al. | |
| 4,079,932 | A * | 3/1978 | Schuetz | 482/82 |
| 4,610,448 | A | 9/1986 | Hill | |
| 4,632,387 | A * | 12/1986 | Guzman | 482/111 |
| 5,234,393 | A * | 8/1993 | Heinrich | 482/81 |
| 5,358,463 | A | 10/1994 | Fuentes | |
| 5,496,244 | A * | 3/1996 | Caruthers | 482/108 |
| 6,672,993 | B2 * | 1/2004 | Stout | 482/55 |
| 6,709,371 | B2 * | 3/2004 | Wu | 482/108 |
| 6,908,415 | B2 * | 6/2005 | Branson | 482/51 |
| D523,493 | S | 6/2006 | Horton | |
| 7,063,646 | B1 * | 6/2006 | Slimi | 482/45 |
| 7,175,573 | B1 * | 2/2007 | Huang | 482/110 |
| 7,318,793 | B2 | 1/2008 | Dubrul et al. | |
| 7,377,888 | B2 | 5/2008 | Godbold | |
| 2003/0186786 | A1 * | 10/2003 | Hsu | 482/52 |
| 2004/0002408 | A1 * | 1/2004 | Rigas | 482/82 |
| 2004/0116256 | A1 * | 6/2004 | Stout et al. | 482/55 |
| 2006/0014615 | A1 | 1/2006 | Godbold | |
| 2006/0040809 | A1 | 2/2006 | Godbold | |

* cited by examiner

*Primary Examiner*—Lori Amerson
(74) *Attorney, Agent, or Firm*—QuickPatents, Inc.; Kevin Prince

(57) ABSTRACT

A device for assisting a user in performing push-up exercises on a floor surface is disclosed. The device includes at least one rigid shell that has a convex outer surface and a concave inner surface. Each surface is mutually connected by a peripheral edge that defines a shell opening. A means for handling is fixed with the concave inner surface within each shell and is adapted to be grasped by the user. Preferably a pair of such shells are adapted to mechanically, selectively and mutually attach at the peripheral edges thereof to form a container thereby. In use, the user grasps the means for handling of each of the shells with either hand and perform exercises on the floor surface by pressing each shell against the floor surface. The convex outer surface requires the user to continuously stabilize the device on the floor surface, thereby exercising muscles not normally exercised while performing the exercises.

8 Claims, 2 Drawing Sheets

CONVEX PUSH-UP HANDLES

CROSS-REFERENCE TO RELATED APPLICATIONS

Not Applicable.

STATEMENT REGARDING FEDERALLY SPONSORED RESEARCH AND DEVELOPMENT

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

FIELD OF THE INVENTION

This invention relates to exercise devices, and more particularly to unstable push-up handles.

DISCUSSION OF RELATED ART

So-called "push-up handles" have become popular for assisting a user in keeping his arms properly positioned while doing "push-up" exercises on a floor surface. Typically such push-up handles provide a means for handling for allowing the user to grasp the handle while doing push-ups, as opposed to the traditional method wherein the user presses against the surface with his open palm, which puts considerably pressure on the user's wrist. Further, such prior art devices typically allow for the handle to rotate about a vertical axis.

Examples of typical prior-art push-up handles can be found in the following patents and patent applications:

| Publication No. | Issue Date | First Named Inventor |
|---|---|---|
| 3,115,338 | Dec. 24, 1963 | Acs |
| 4,610,448 | Sep. 9, 1986 | Hill |
| 5,358,463 | Oct. 25, 1994 | Fuentes |
| D523,493 | Jun. 20, 2006 | Horton |
| 7,377,888 | May 27, 2008 | Godbold |
| 2006/0146515 | Jan. 19, 2006 | Godbold |
| 2006/0040809 | Feb. 23, 2006 | Godbold |

Such prior art push-up handles suffer from the drawback that they are stable when on the floor surface, and as such the user does not have to stabilize such handles with muscles that are not otherwise exercised by such handles. As a result, using such handles prevents complete exercising of the arm, shoulder, back muscles, abs, etc.

An exercising weight disclosed in U.S. Pat. No. 6,709,371 to Wu includes a handle with a rounded outer surface. Such a device is not well-suited to use while doing push-up exercises because the handle is significantly above the center of gravity of such a device. As such, this type of product is too unstable to be easily used by a person performing push-ups. Further, a pair of such devices is not easily transported or stored, and makes no provision for containing other exercise implements such as a jump rope, or the like. Further, such a device is weighted, which is fine for people desiring to do weight-based exercises, but is a hindrance for user's wishing to do push-up exercises.

Therefore, there is a need for a device that provides push-up handles for engaging with a floor surface. Such a needed device would allow natural rotation and positioning of the wrists while performing push-up exercises therewith, but would also provide a convex contact surface with the floor so that additional muscles are exercised. The user of such a needed device would be able to establish any desired handle angle for added challenge. Such a needed device would not be so unstable as to be unusable, however, keeping the handles of such a device proximate to the center of gravity of the device. Further, such a needed device would be easily transported, handled, and stored, and would provide a container for holding other exercising implements such as a jump rope, or the user's wallet and keys, for example. The present invention accomplishes these objectives.

SUMMARY OF THE INVENTION

The present device is a device for assisting a user in performing exercises, such as pushups, on a floor surface. The device includes at least one rigid shell that has a convex outer surface and a concave inner surface. Each surface is mutually connected by a peripheral edge that defines a shell opening. A means for handling is fixed with the concave inner surface within each shell and is adapted to be grasped by the user. Preferably a pair of such shells are adapted to mechanically, selectively and mutually attach at the peripheral edges thereof to form a container thereby.

In use, the user may grasp the means for handling of each of the shells with either hand and perform exercises on the floor surface by pressing each shell against the floor surface. The convex outer surface requires the user to continuously stabilize the device on the floor surface, thereby exercising muscles not normally exercised while performing the exercises.

The present device provides push-up handles for engaging with a floor surface that allow rotation of the wrists while performing push-up exercises therewith, but that also provide a convex contact surface with the floor so that additional muscles are exercised. The present invention is not so unstable as to be unusable, however, in that means for handling of the present device are kept proximate to the center of gravity of the device. A user of the present invention is able to establish any desired handle angle for added challenge. Further, the present device is easily transported, handled, and stored, and provides a container for holding other exercising implements such as a jump rope, or the user's wallet and keys, for example. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
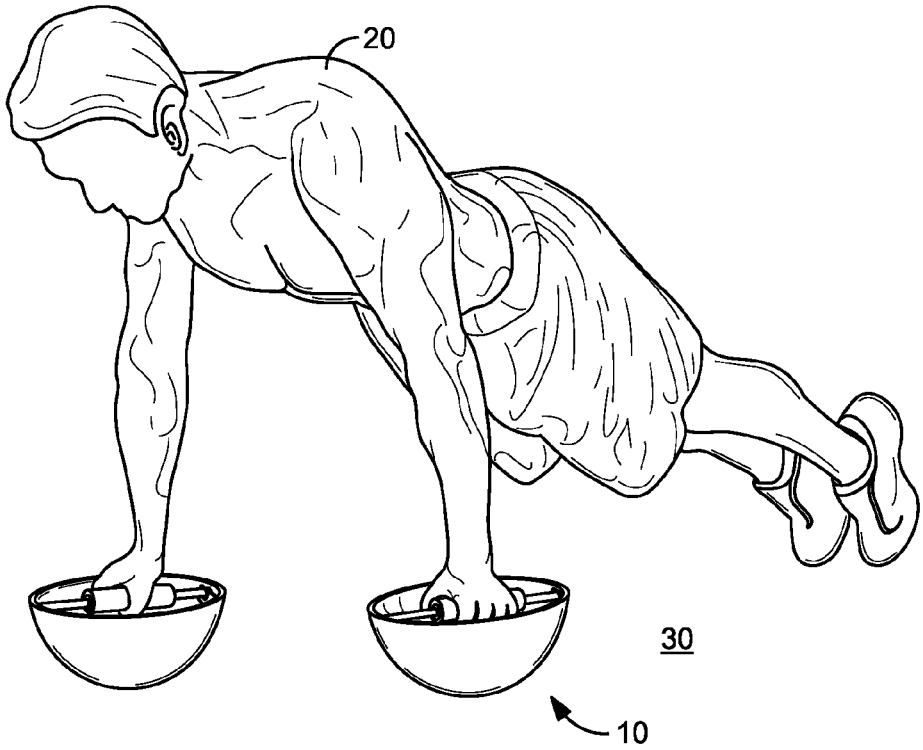
FIG. 1 is a perspective view of the invention in use.
Figure 2:
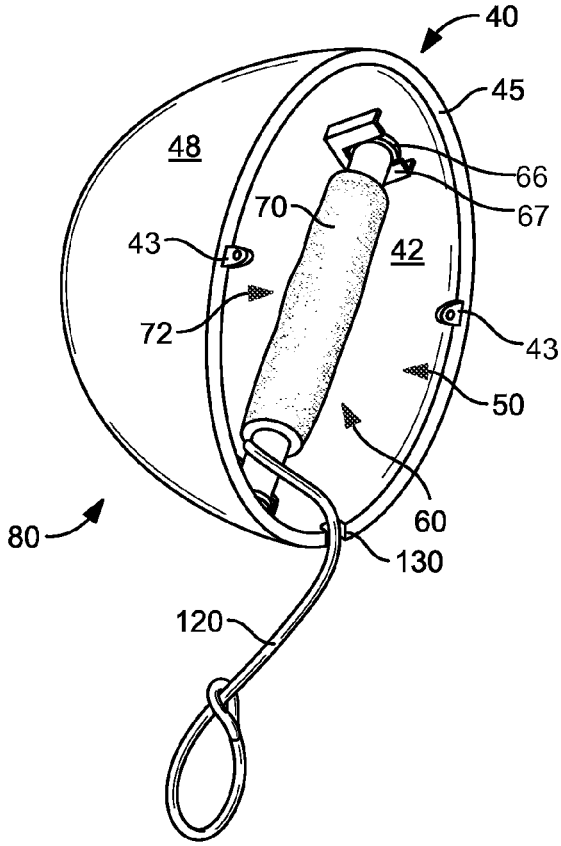
FIG. 2 is a perspective view of the invention, illustrating a single rigid shell thereof with a means for handling and a tether.

FIGS. 1 and 2 illustrate a device 10 for assisting a user 20 in performing exercises, such as push-ups, on a floor surface 30. The device 10 includes at least one rigid shell 40 that has a convex outer surface 48 and, preferably, a concave inner surface 42. Each surface 42,48 is mutually connected by a peripheral edge 45 that defines a shell opening 50. Each shell 40 is preferably made from a rigid plastic material, such as ABS, PVC, or the like. The outer surface 48 may also be coated with a high-friction coating, such as an elastomeric coating (not shown), or may be formed with a rough texture for providing a non-slip surface (not shown).

A means for handling 60 is fixed with each shell 40, such as on a top surface thereof (not shown), or preferably on the concave inner surface 42 therein in embodiments having the inner surface 42. In the preferred embodiment, each means for handling 60 is a bar-like structure adapted to be grasped by the user 20. In one embodiment of the invention, each means for handling 60 includes a resilient material 70 therearound for providing a comfortable grip 72 (FIG. 2), such as a closed cell foam or elastomeric material.

Figure 4:
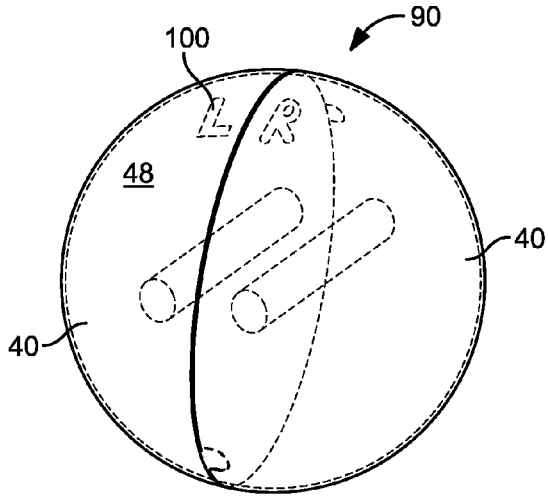
FIG. 4 is a perspective view of the invention, illustrating a pair of the shells as selectively mechanically fixed together at peripheral edges thereof.

Preferably the at least one rigid shell 40 includes a pair of such shells 40 which are adapted to mechanically, selectively and mutually attach at the peripheral edges thereof to form a container 90 thereby (FIG. 4). Preferably each shell 40 is formed into a partial egg shape 80 (FIG. 2), such that the container 90 is generally spherical. Each shell 40 is mutually held to the other shell 40 by at least a pair of mechanical snaps 43, screw threads (not shown), or the like.

Figure 3:
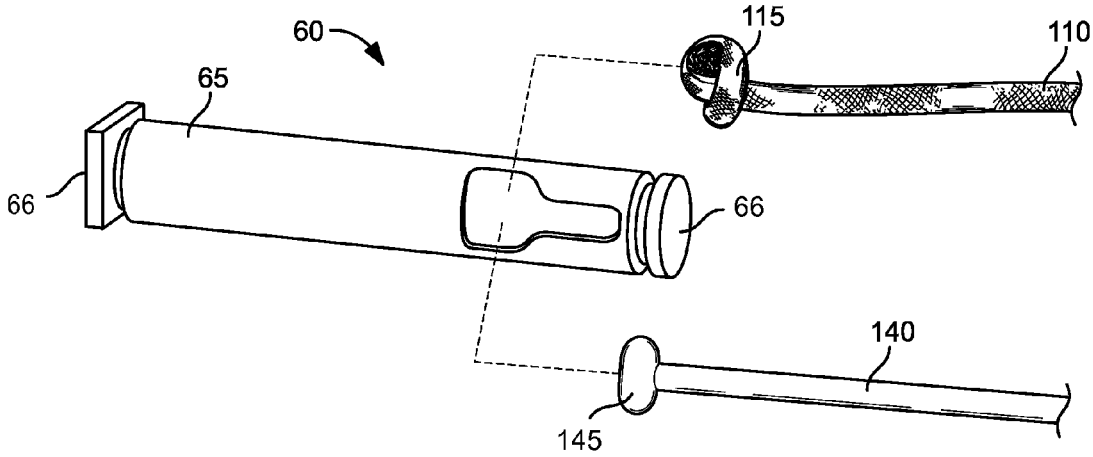
FIG. 3 is a perspective view of a handle portion of the means for handling of the invention, illustrating an end of a jump rope and an end of a resistance member, each of which being selectively fixable with the handle portion.

In one embodiment of the invention, each means for handling 60 is a rigid handle portion 65 that is selectively detachably connected to the concave inner surface 42 of the shell 40. Each handle portion 65 may include a tab 66 on each end thereof that mechanically cooperates with a slot arrangement 67 of each shell 40, or some other suitable mechanical fastening arrangement may be used. Preferably at least one tab 66 is non-circular (FIG. 3). Each means for handling 60 may further be ergonomically matched to the shape of a grasping human hand (not shown), and each shell 40 may include an indicia 100 for indicating use with either the left or right hand (FIG. 4), as determined by the ergonomically shape of each means for handling 60.

In one embodiment of the invention, each handle portion 65 may be selectively fixed to one end 115 of a jump rope 110. In this embodiment the jump rope 110 is completely storable within the container 90 when the shells 40 are mutually fixed together. Likewise, each handle portion 65 may be selectively fixed to one end 145 of a resistance member 140, such as a length of resilient elastomeric material. In this embodiment the resistance member 140 can be bent so that it is completely storable within the container 90 when the shells 40 are mutually fixed together. A flexible tether 120 may be further included, fixed around one of the means for handling 60, for facilitating the holding, transportation and storage of the device 10. Such a tether 120, when the shells 40 are mutually fixed together, traverses a tether notch 130 formed in the peripheral edge 35 of at least one of the shells 40 (FIG. 2).

In use, the user 20 may grasp the means for handling 60 and perform exercises on the floor surface 30 by pressing each shell 40 against the floor surface 30. The convex outer surface 48 requires the user to continuously stabilize the device 10 on the floor surface 30, thereby exercising muscles not normally exercised while performing the exercises.

While a particular form of the invention has been illustrated and described, it will be apparent that various modifications can be made without departing from the spirit and scope of the invention. For example, the shape of each pair of shells 40 is illustrated as spherical, yet the shells 40 may be made in various other shapes, including an oblong egg shape 80, or even irregular shapes (not shown). Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A push-up device for assisting a user in performing exercises on a floor surface, comprising: a pair of rigid shells each having a convex outer surface and a concave inner surface, each surface connected by a peripheral edge that defines a shell opening, each shell adapted to mechanically, selectively mutually and removably attach at the peripheral edges thereof to form a container thereby;

a means for handling fixed to the concave inner surface within each shell and adapted to be grasped by one hand of the user;

a fastening arrangement on an inner concave surface of each shell;

whereby the container is separable into two shells and a user is able to grasp the means for handling of each shell to perform exercises on a floor surface by pressing each outer shell surface against the floor surface, the user continuously stabilizing the device on the floor surface, and whereby the user subsequently attaches each shell mutually together to re-form the container for storage and portage.

2. The device of claim 1 wherein each means for handling includes a resilient material therearound for providing a comfortable grip.

3. The device of claim 1 wherein the means for handling of one shell is ergonomically matched to the user's left hand and wherein the means for handling of the other shell is ergonomically matched to the user's right hand, and wherein each shell includes an indicia for indicating use with either the left or right hand.

4. The device of claim 1 wherein the shell is formed into a partial egg shape, such that the container is generally spherical.

5. The device of claim 1 wherein each means for handling is a rigid handle portion detachably connected to the concave inner face of the shell, and wherein each handle portion may be selectively fixed to one end of a jump rope, the jump rope completely storable within the container when the shells are mutually fixed together.

6. The device of claim 1 further including a tether fixed around one of the means for handling, and wherein at least one of the shells includes a tether notch formed in the peripheral edge thereof, such that when the shells are mutually fixed together, the tether may traverse the tether notch to provide a tether for facilitating the holding and transportation of the device.

7. The device of claim 1 wherein each means for handling is a rigid handle portion detachably connected to the concave inner face of the shell, and wherein each handle portion may be selectively fixed to one end of an elastic resistance member, the resistance member completely storable within the container when the shells are mutually fixed together.

8. The device of claim 1 wherein each means for handling is a rigid handle portion substantially parallel to the peripheral edge of the shell.

* * * * *